US006581248B1

(12) United States Patent
Müller et al.

(10) Patent No.: US 6,581,248 B1
(45) Date of Patent: Jun. 24, 2003

(54) CARDING MACHINE WITH DRAWING ROLLERS AT THE OUTLET

(75) Inventors: Christian Müller, Winterthur (CH); Jürg Faas, Andelfingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/355,140

(22) PCT Filed: Jan. 23, 1998

(86) PCT No.: PCT/CH98/00022

§ 371 (c)(1),
(2), (4) Date: Sep. 5, 2000

(87) PCT Pub. No.: WO98/32903

PCT Pub. Date: Jul. 30, 1998

(30) Foreign Application Priority Data

Jan. 23, 1997 (CH) ..... 153197
Sep. 1, 1997 (DE) ..... 197 38 053

(51) Int. Cl.[7] ..... D01H 5/32
(52) U.S. Cl. ..... 19/239; 19/240
(58) Field of Search ..... 19/65 A, 105, 19/98, 236–240, 242, 258, 260, 266, 269, 270

(56) References Cited

U.S. PATENT DOCUMENTS

| | | | | |
|---|---|---|---|---|
| 4,075,739 A | | 2/1978 | Staheli | |
| 4,100,649 A | | 7/1978 | Erismannm et al. | |
| 4,271,565 A | | 6/1981 | Grunder | |
| 4,369,550 A | * | 1/1983 | Meile | 19/240 |
| 4,473,924 A | * | 10/1984 | Hartmannsgruber et al. | 19/239 |
| 4,512,061 A | * | 4/1985 | Hartmannsgruber et al. | 19/239 |
| 4,653,153 A | * | 3/1987 | Felix et al. | 19/240 |
| 4,955,266 A | | 9/1990 | Stäheli et al. | |
| 4,974,296 A | | 12/1990 | Vidler | |
| 4,982,477 A | | 1/1991 | Hösel | |
| 5,018,248 A | | 5/1991 | Haworth et al. | |
| 5,134,755 A | * | 8/1992 | Jornot et al. | 19/239 |
| 5,161,284 A | * | 11/1992 | Leifeld | 19/260 |

(List continued on next page.)

FOREIGN PATENT DOCUMENTS

| | | |
|---|---|---|
| DE | 1921248 | 2/1970 |
| DE | 1919929 | 11/1970 |
| DE | 2230069 | 1/1973 |
| EP | 417614 | 2/1994 |
| EP | 643160 | 3/1995 |
| EP | 701012 | 3/1996 |
| EP | 617149 | 8/1997 |
| EP | 790338 | 8/1997 |
| EP | 0799916 | 10/1997 |
| GB | 1288475 | 11/1972 |
| JP | 15523177 | 6/1976 |
| JP | 5601778 | 10/1976 |
| JP | 59187629 | 1/1983 |

OTHER PUBLICATIONS

PCT Search Report dated May 7, 1998.

*Primary Examiner*—Gary L Welch
(74) *Attorney, Agent, or Firm*—Dority & Manning

(57) ABSTRACT

A card is equipped with a regulating drafting system at the card delivery arrangement. The measuring values for regulating the drafting system are obtained from the drafted fibre sliver. The sliver depositing device can be pre-controlled relative to the drafting system in order to keep the stresses in the fibre sliver between the drafting system and the sliver depositing device within limits. A fibre sliver storage device (11) is arranged upstream from the regulating drafting system (13) with relatively small capacity. In order to enable timely action if long term deviations are detected in the fibre sliver mass (m) delivered, a sensor (10) can be arranged between the card (1) and the regulating drafting system (13), and the base rotational speed (U14) of the drive (25, 26) of the regulating drafting system (13) can be adapted based on signals transmitted by the sensor (10).

15 Claims, 5 Drawing Sheets

U.S. PATENT DOCUMENTS 5,248,925 A * 9/1993 Jornot ..... 19/240
5,274,883 A 1/1994 Eke
5,377,385 A * 1/1995 Jornot et al. ..... 19/240
5,388,310 A 2/1995 Haworth
5,394,591 A * 3/1995 Jornot et al. ..... 19/240
5,398,380 A * 3/1995 Leifeld ..... 19/98
5,400,476 A * 3/1995 White ..... 19/239
5,412,301 A * 5/1995 Jornot et al. ..... 19/240
5,428,870 A * 7/1995 Rutz et al. ..... 19/240
5,461,757 A * 10/1995 Leifeld ..... 19/239
5,509,179 A * 4/1996 Mondini et al. ..... 19/239
5,528,798 A 6/1996 Strobel et al.
5,544,390 A * 8/1996 Hartung et al. ..... 19/240
5,611,115 A 3/1997 Faas
5,713,106 A * 2/1998 Dammig ..... 19/240
5,815,889 A * 10/1998 Barth et al. ..... 19/240
5,855,043 A * 1/1999 Leifeld ..... 19/98
5,915,509 A * 6/1999 Faas et al. ..... 19/98
5,943,740 A * 8/1999 Slavik et al. ..... 19/239

* cited by examiner

CARDING MACHINE WITH DRAWING ROLLERS AT THE OUTLET

The present invention concerns a regulating drafting system, in particular but not exclusively, for application at a card machine delivery arrangement. The present invention furthermore concerns a card with a first sensor for scanning the mass of the fibre material delivered by the card, in particular of the card sliver, the signal transmitted by the sensor being used for regulating the drive of the supply device of the card and preceded by a sliver storage device.

BACKGROUND

It is known that cards can be provided with regulating drafting systems in order to improve, or to ensure respectively, the evenness of the sliver delivered by the card. The following documents are cited merely as examples of the numerous publications representing the state of the art concerning this subject:

DE-A-1921248 Zellweger
DE-A-2912576 Zellweger
US-B-4075739 Rieter
EP-C-275471 Rieter The solutions according to the sate of the art permit "maintaining of the sliver weight" (Long term regulation) as well as the elimination of the influence of variable lap layer thickness at the intake (short term disturbances).

Regulating drafting systems arranged at the card delivery are known from the following publications:

JP-Gbm-56017/78 Nihon Keikizai KK
JP-A-155231/77 Nagoya Kinzoku Harinuno KK
DE-A-1931929 Zinser
DE-A-2230069 Texcontrol
CH-B-599993 Graf
EP-C-354653 Hollingsworth
EP-A-544425 Hollingsworth
EP-A-6041137 Hollingsworth
EP-A-617149 Grossenheiner Textilmaschinenbau GmbH
EP-A-643160 Howa Machinery, Ltd.
EP-A-692560 Chemnitzer Spinnereimaschinenbau GmbH
US-B-5400476 Myrick-White, Inc.

The card operates at a constant (pre-settable) production speed; i.e. the fibre sliver is delivered at a pre-determined speed from the delivery arrangement. The function of a regulating drafting system implies that the draft be variable (controllable). Provision of a large sliver storage device between the card and the drafting system intake is undesirable. Thus the delivery speed of the drafting system must be variable. This, however, creates problems concerning the drive of the sliver deposition or coiler system, the inertia of which is relatively considerable, arranged downstream from the drafting system.

Various devices are known, e.g. from the DE-OS-19 19 929, in which a sliver storage device is arranged between the card and a regulating drafting system. This can be seen in particular from the FIGS. 3 and 4 of the DE-OS reference. Adjoining the regulating drafting system, a sliver storage device is arranged driven by a separate motor. The measured values determined by the pair of measuring rolls upstream from the regulating drafting system are compared to the pre-set desired values. The resulting deviation signal serves for controlling the drive motor of the intake pair of rolls of the drafting system in order to adapt the draft ratio, and to level out thin and thick places respectively. At the same time, this signal is transmitted to the control device of the card, or of its main drum respectively, in such a manner that this drive also can be adapted correspondingly. The reaction of the card, however, is subject to substantially higher inertia than the drafting system. The resulting differences in the material delivery speed, and in the material intake speed respectively, are levelled out in the sliver storage device adjoining the card. The storage device in this arrangement is provided with sensors for scanning the contents of the storage device. Based on the contents scanned by the sensors in the sliver storage device, the drives of the fibre sliver source (card) and of the sliver take-up device (coiler) are charged correspondingly in such a manner that the contents of the sliver storage device is maintained substantially constant. This adaptation of the two drives however, results in additional differences, especially as the elements of the card (e.g. the card main drum) are subject to inertia influences differing from the ones in the elements of the sliver depositing device (coiler). Furthermore, in this case exact scanning of the sliver storage device contents must be provided.

Furthermore, from the previously published DE-A1-44 24 490 a co-ordination of cards is known in which a storage device is coordinated to each card downstream and in which the card slivers delivered by the individual storage devices after passing through a drafting system are delivered to a common sliver deposition device or coiler. In order to compensate for the loss of one of the card slivers supplied to the drafting system, the delivery speed of the drafting system is reduced until the missing card sliver has been re-inserted. In this arrangement a scanning sensor is co-ordinated to each individual card sliver. Owing to the reduction in delivery speed, corresponding to the loss of one card sliver, the fibre sliver reserve for the draw frame is exhausted more slowly than in the normal operating mode at higher intake speeds. In the example shown, an increase of the card delivery speed also is proposed if the fibre sliver storage device arranged downstream is depleted to below a pre-determined value in such a manner that the operation of the subsequent draw from is not jeopardized. The arrangement shown is suitable for levelling out massive short term variation (loss of a sliver). Levelling out long term deviations however, is not envisaged using this arrangement, or is solved unsatisfactorily only.

For levelling out long period mass deviations in the fibre sliver delivered by the card it is proposed in DE-A1 29 12 576 that the thickness of the fibre sliver delivered by the card be measured and compared to a pre-set desired value. The signal thus determined is used in controlling the material supply device (feed roll) arranged upstream from the card. Owing to this arrangement long period deviations in the mass of the card sliver delivered can be reacted on. Avoiding and eliminating of short wave deviations e.g. using a regulated drafting system arranged downstream is not envisaged in the arrangement described.

The solutions proposed thus far generally provide the drafting system for levelling out short term variations in the fibre sliver. They correspondingly propose of a measuring sensor at the intake of the drafting system.

SUMMARY OF THE PRESENT INVENTION

Objects and advantages of the present invention will be set forth in the following description, or may be obvious from the description, or may not be learned through practice of the invention.

The present invention in a first aspect provides a card with a regulating drafting system arranged at the card delivery. Measuring values are obtained from the drafted fibre sliver for regulating the drafting system (measuring point at the drafting system delivery). For this purpose the drafting bodies (i.e. the rotatable bodies driven at the higher speed for generating the draft) can be used as sensors. The term "bodies" in this context is understood to comprise such elements such as rolls, (discs), and cylinders.

The drafting bodies can be the delivery elements of the drafting system, in which arrangement the take-in bodies can be driven at a (constant) speed corresponding to the delivery speed of the fibre sliver leaving the card.

The take-in bodies can be coupled to the drive of the card delivery arrangement, or they can be driven under control synchronized with the card delivery arrangement. The take-in arrangement of the drafting system also can be provided with measuring elements, which permits a combination of the arrangement according to the state of the art.

The measuring values used for regulating the draft in the drafting system can be transmitted also to the card regulating device, e.g. for regulating the sliver weight on the card itself. The card preferentially also is equipped with a regulating system which can level out short term weight deviations in the lap fed in.

In cases in which the drafting system delivery speed is variable (for effecting controlled draft adaptations) the sliver deposition arrangement can be driven according to one of the known working principles or according to an equivalent or better solution. The second aspect of the present invention concerns the problems arising in this connection.

The present invention in a second aspect provides a card with a regulating drafting system at the card delivery, in which arrangement for regulating the draft, measuring values are obtained at the intake or at the delivery of the drafting system and the draft is adapted accordingly by changing the delivery speed. In this case the drive of the sliver depositing device (coiler) also is controlled as a function of the measuring values, preferentially in such a manner that the fibre sliver portion between the drafting system delivery and the intake of the sliver depositing device is not subject to an elongation exceeding a certain limit.

The present invention in a third aspect is based on the objective to create a method, and an apparatus respectively, which serves out long term and short term mass deviations in the card sliver delivered by a card, in which arrangement on one hand the rotational speed can be maintained constant and on the other hand storage elements required for balancing out different transporting speeds of the fibre sliver delivered can be kept as small as possible.

This objective is met in that the sensor between the card and the regulating drafting system which is used for regulating the drive of the supply device of the card is arranged between the card and the regulating drafting system and that the base rotational speed of the regulating drafting system is adaptable as a function of the signal transmitted by the sensor.

The base rotational speed is understood to be the rotational speed, or the ratio of the rotational speeds of the individual pairs of rolls of the regulating drafting system which is set for the normal operation of drafting the card sliver supplied. On the basis of this rotational speed, the regulating action is effected by the pair of rolls the rotational speed of which can be regulated in order to level out short wave variations in the fibre mass. As soon as the sensor arranged downstream from the card transmits a signal indicating a long term drift in the fibre mass, the base rotational speed of the regulating drafting system arranged subsequently is changed correspondingly. In this manner, on one hand, timely reaction against such drifting is possible and on the other hand the transporting speed of the fibre sliver supplied to the regulating drafting system can be held on a level not requiring changes in the delivery speed of the card, and the filling level in the fibre sliver storage device can be maintained on an approximately constant level. This signifies that the delivery rotational speed of the card can be kept substantially constant and the capacity of the storage device can be held small.

Furthermore, it is proposed that the sliver storage device be provided with a filling level sensor, the signals of which additionally are used for adapting the base rotational speed of the drafting system. Thus an additional checking control is effected for the buffer zone between the card and the drafting system in order to effect corresponding actions. This sensor in the sliver storage device in this arrangement serves as a supplementary completion and at the same time also for checking the first sensor arranged at the card delivery. The filling level sensor can be laid out with a tolerance spectrum in order to avoid continual increase and decrease of the base rotational speed. This means that the control unit generates a control signal for changing the base rotational speed only in case the signal exceeds the pre-set tolerance zone. In case a disturbance develops in the first sensor downstream from the card, or in case of a break-down of this sensor, the control actions effected on the base rotational speed are initiated by the filling level sensor. During normal operation, the control of the base rotational speed is based on a signal blended from the signals of the first sensor and of the filling level sensor.

Furthermore it is proposed that the rotational speed of the intake rolls of the drafting system can be regulated for levelling out mass deviations detected in the fibre material. In this arrangement a buffer zone between the drafting system and the subsequently arranged sliver depositing device (coiler) can be dispensed with. This signifies that the transport variations possibly occurring in the fibre sliver caused by the regulating action are shifted to the zone upstream from the drafting system.

In this arrangement it is possible, as proposed furthermore, that the delivery rolls of the drafting system be drivingly connected to the drive mechanism of a subsequently arranged sliver deposition device. The drive of the sliver deposition device in this arrangement automatically is adapted as the base rotational speed and is increased or decreased in such a manner that constant relations prevail at all times between the delivery roll of the drafting system and the calender rolls of the sliver depositing device.

For detecting short wave mass deviations in particular, it is proposed that a further sensor be provided for scanning the fibre material delivered by the card, the signals transmitted being used for adapting the regulating device of the drafting system.

Preferentially, the first sensor is arranged between the card and the sliver storage device. In this arrangement, corrective action can be effected early for changing the base rotational speed of the drafting system arranged subsequently in order to maintain the transporting speed of the card sliver supplied to the drafting system approximately constant in spite of the presence of a long term drift in the fibre mass. This means that the fibre sliver buffer present in the sliver storage device arranged upstream can be maintained approximately constant. Using this arrangement the fibre sliver buffer, and the fibre sliver storage device respectively, can be kept small in its capacity.

Furthermore, it is proposed that the further sensor be arranged between the fibre sliver storage device and the regulating drafting system or adjoining the drafting system. In this arrangement this sensor should be arranged as closely as possible near the drafting system in order to keep any time delays between the measuring point and the regulating action as small as possible.

It is also feasible that a device according to the third aspect of the present invention be combined with a device according to the first and/or the second aspect. This will be discussed in the following with reference to the FIG. 6 in more detail.

Embodiments of the present invention are explained in the following in the sense of examples with reference to the illustrated Figures. It is shown in the:

DETAILED DESCRIPTION

Figure 1:
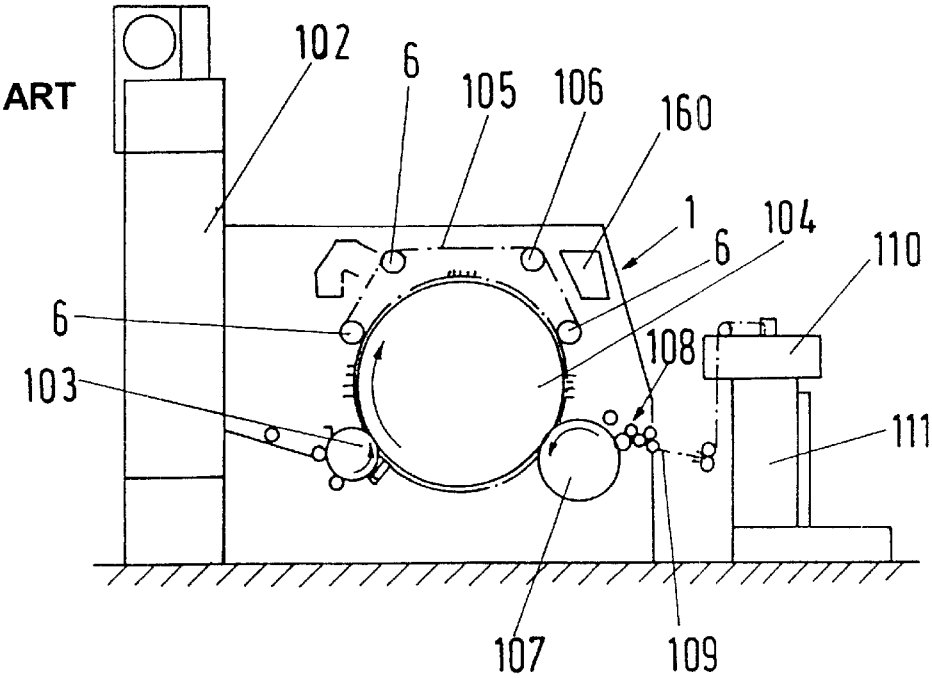
Fig.1 PRIOR ART
FIG. 1 a schematic side view of the card C 50 produced by the present assignee, essentially the same Figure having been used in EP-A-790 338 as well as in EP-A-701 012, FIG. 2 the same side view, where this Figure (which also was shown in EP-A-799 915) is used for explaining the control system rather than the machine design, FIG. 3 a schematic view of a card according to the FIGS. 1 and 2 with a drafting system according to the present invention, the basic elements of this drafting system being shown in the FIG. 3A, FIG. 4 a schematic view of a first variant according to the FIG. 3, and the FIG. 3A respectively, the FIG. 4A showing a detail of the drafting rolls, FIG. 5 a schematic view of a second variant according to the FIG. 3, and the FIG. 3A respectively, FIG. 6 a schematic side view of a card with a device according to the third aspect of the present invention, and in the FIG. 7 a schematic view diagrammatically showing the mass curve of the card sliver in connection with the curve of the adapted rotational speed of the drafting system.

Reference will now be made in detail to embodiments of the invention, examples of which are shown in the drawings. Each example is provided by way of explanation of the invention, and not as a limitation of the invention. For example, features illustrated or described as part of one embodiment may be used with another embodiment to yield still a third embodiment. It is intended that the present invention include such modifications and variations.

In the FIG. 1 a revolving flat card 1, known as such, is shown schematically, e.g. the card C 51 produced by the present assignee. The fibre material is supplied in the form of opened flocks to the filling chute 102, is taken over by a licker-in 103 (also called taker-in) as a lap layer and in the form of cleaned and to a large extent opened material is transferred to a drum 104 (also called main drum). The main drum is driven in such a manner that it rotates about its axis in the direction indicated by the arrow. The fibre material on the cylindrical surface of the drum 104 which is provided with a clothing (not shown) forms a web which in the "main carding zone" (between the drum 104 and a set of revolving flats 105) is carded, in which arrangement short fibres as well as also finer waste particles are eliminated and neps are dissolved, or eliminated respectively. The revolving flats are held by a traction means and move about deflecting rolls 106 in the direction opposite to, or in the same direction as, the direction of rotation of the main drum 104.

Fibres from the fibre web present on the drum 104 are taken off by a take-off roll 107 and are transformed into a card sliver 109 in a delivery section 108 formed by various rolls. This card sliver is deposited by a sliver depositing device (or coiler) 110 in cycloid windings in a transporting can 111. The sliver depositing device 110 can be provided with its own ("autonomous") drive mechanism - compare e.g. EP-A-671 355.

Figure 2:
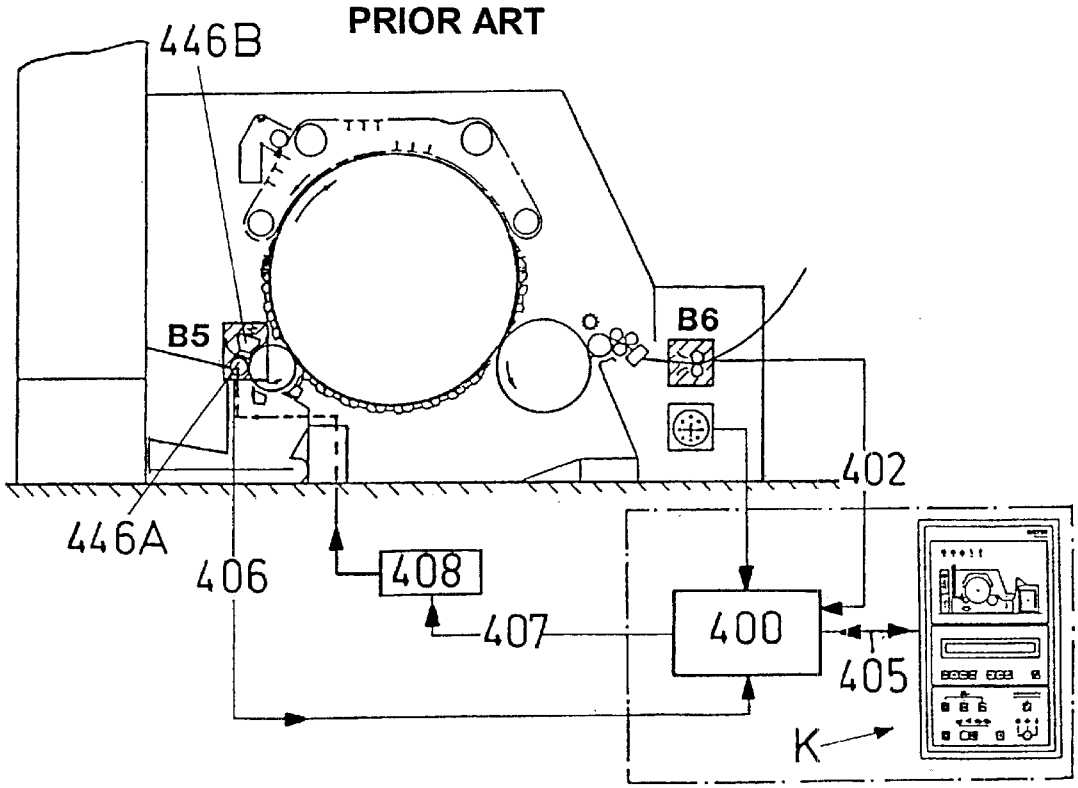
Fig. 2 PRIOR ART

In the FIG. 2 a computer 400 is shown schematically with input and output signal ports. Input consists of signals transmitted from two sensors B5 and B6 which are to be explained further in the following, as well as of signals which among others represent the speed of the card sliver at the card delivery, and various data such as e.g. pre-set values of the sliver weight. The basic principle of the sliver regulation is based on three actions, namely the pre-control, or the pre-setting respectively, of the delivery speed of the card sliver, a "long term" regulation, and a regulation with a "short term supplement" at the intake where deviating valves occurring at the moment of the supply are to be entered.

As can be seen from the FIG. 2 a sensor B5 which is arranged at a feed trough 446B scans the cross-sectional variations in the entering lap layer. These correspond to the movements of the pivotably mounted feed trough relative to the feed roll 446A. The sensor B5, as shown in the FIG. 2, transmits a signal 406 depending on the cross-section of the fibre material to the computer 400. The electronic system, using the signal 407, via a control device influences the drive motor 408 of the feed roll 446A and thus the supply speed of the feed roll.

The sensor B6 also shown in the FIG. 2 scans the card sliver delivered by the card and transmits an electric signal 402 depending on the sliver weight to the regulating device. Via a funnel the card sliver leaving the transverse sliver take-off device is fed to the nip point of two stepped rolls. The lower roll is driven and the upper roll is supported vertically movable by a spring-loaded lever. This roll is driven by the card sliver leaving the card and the lift position, or the distance between the axles of the two rolls, corresponds to the thickness of the card sliver.

A desired value is entered as an input signal 402 into the computer 400 independently of the delivery speed and is compared with the desired value of the sliver weight entered previously into the electronic system. The rotational speed of the feed roll is influenced correspondingly by the control system in order to maintain the sliver weight constant at the delivery. The delivery speed in case of a change in a desired value (e.g. during the start-up phase, or during the slow-down phase) is controlled by a control cycle. This serves for correspondingly adapting the rotational speed of the delivery drive motor. An initiator arranged on the stepped roll transmits impulses to the computer 400.

These are processed as to represent the speed at the delivery (Vauslauf). This speed is compared to a pre-set desired delivery speed. The resulting corrective value now is transmitted to an inverter. The regulating device after a change in a pre-set value remains active for only about 30 seconds, namely until the speed is adapted. Thereafter the regulating device remains inactive until a next change in a pre-set value is required.

A control panel K is connected to the computer 400 via a circuit 405 which permits bi-directional communication.

Figure 3:
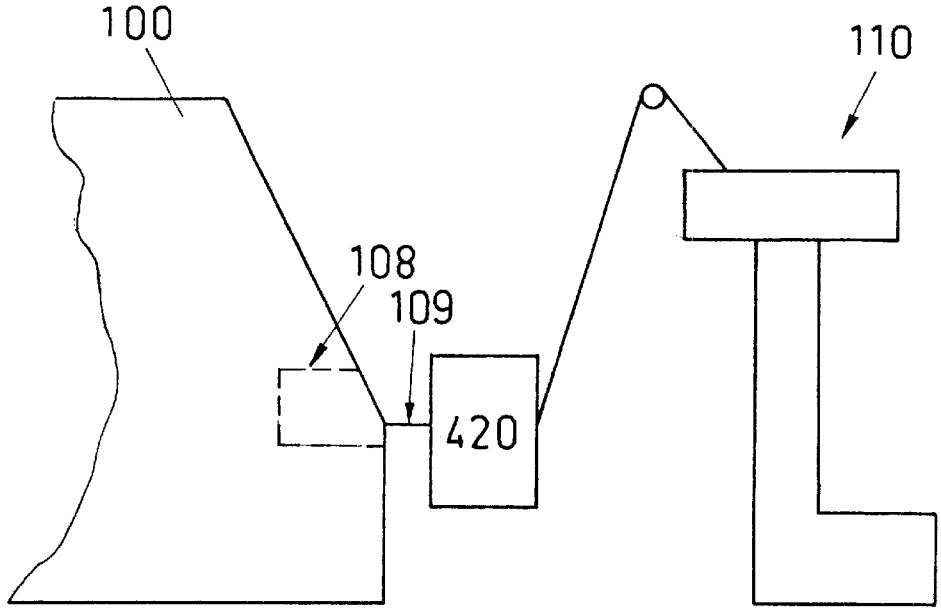

In the FIG. 3 the card 100 is shown again (including its delivery arrangement 108) and the sliver depositing device 110 with a drafting system module 420 according to the present invention arranged in between. The module 420, indicated in the FIG. 3 just as a box, in all embodiments comprises a rotatable pair of intake bodies 422, 424 (FIG.

3A) and a rotatable pair of delivery bodies 426, 428. The "bodies" can be rolls, (discs), cylinders, or similar rotatable bodies defining a nip point 430, and 432 respectively, each for the fibre sliver 109 and a drafting zone VF between them. The module 420 also comprises a controllable drive motor M which can change the rotational speed of the delivery bodies 426, 428 according to control impulses to be described later on in order to change the draft in the drafting zone VF correspondingly. The draft is defined by the ratio Va/Ve, where Ve represents the linear (tangential) speed of the intake bodies 422, 424 in the nip point 430 and Va represents the corresponding speed of the delivery bodies 426, 428 in the nip point 432. An arrangement of this kind is provided in each of such modules (also according to the state of the art). With reference to the FIGS. 4 and 5, two embodiments 420A (FIG. 4) and 420B (FIG. 5) now are discussed in the following, each laid out according to an aspect of the present invention.

Figure 3A:
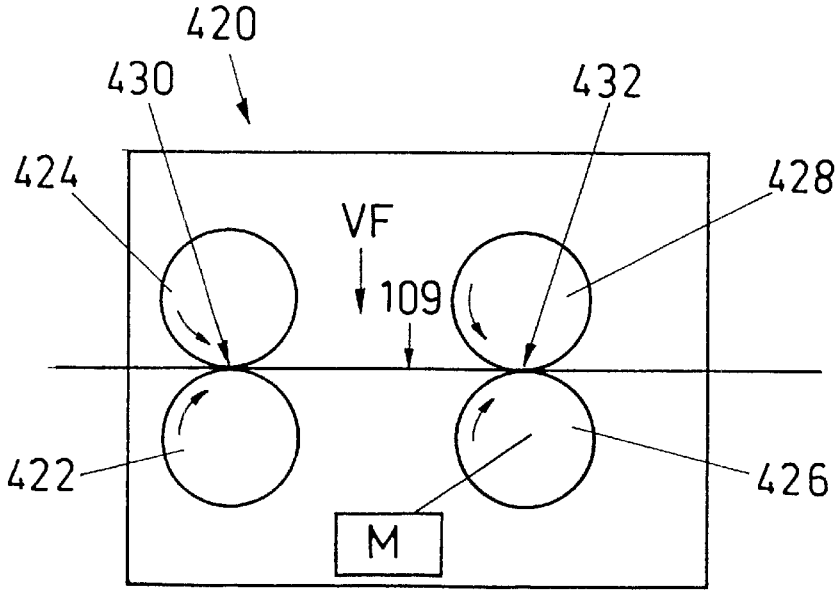

In FIG. 4 again the delivery section 108 of the card is shown (schematically) with its drive arrangement 107 and a frequency inverter 106 co-ordinated to this drive arrangement which receives control signals from the computer 400 (FIG. 2). As indicated schematically with the connecting line 105, the lower intake roll 422A of the module 420A is drivingly connected to the delivery section 108 (e.g. via a suitable gear train) in such a manner that the later is driven synchronously with the card delivery arrangement. The term "roll" in this case concerns a disc-shaped body which is supported rotatable about an axis 434, or 436 respectively (FIG. 4A), and the length L of which in its axial direction is markedly shorter than its diameter. The cylindrical surface of the roll 422A is provided with a groove 438 whereas the roll 424A is provided with a corresponding flange 440. The groove 438 and the flange 440 together form the nip point 430 (FIG. 3A). The fibre sliver 109 is condensed by a funnel 104 (FIG. 4) and upon insertion into the narrowing room between the rolls 422A, 424A is condensed further. The lay-out of the rolls 422A, 424A illustrated in the FIG. 4A is shown as an example merely - many alternative designs are known which also permit condensing at the nip point. The rotation of the lower roll 422A can be transmitted to the upper roll 242A using suitable means (see e.g. EP-A417 614).

The drafting rolls 426A, 428A also can be laid out according to the FIG. 4A in which arrangement the lower roll 426A is driven at a variable rotational speed by a controllable motor M (compare the FIG. 3A) in such a manner that, in relation to the delivery section 108, a variable linear speed at the nip point 432 is achieved. To the motor M a drafting system regulator 42 and a servo device 44 are coordinated. The regulator 42 receives signals from a first sensor 46 which scans the rotational speed (linear speed) of the intake roll 422A and from a measuring device 48, which measures the "weight" of the fibre sliver delivered. The last mentioned device (sensor) is discussed in the following in more detail. To the regulator 42 also a desired value for the sliver weight is entered via the input port SW. The regulator 42 can be integrated in the computer 400 (FIG. 2) and can be operated via the control panel.

The relations between the elements described here will be clear to the specialist in the field, and here they thus are summarized merely:

i) The intake rolls 422A, 424A take over the fibre sliver 109 at the delivery speed of the card and this speed is signaled to the regulating device 42 by the sensor 46.

ii) The fibre sliver weight signaled by the measuring device 48 is compared to the desired value in the regulating device 42.

iii) Based on deviations detected in the sliver weight measured deviating from the desired value, a desired value Ds for the rotational speed of the drafting rolls 426A, 428A is determined and via the circuit 50 is transmitted to the regulating device 44. The desired value Ds is determined according to a pre-determined control algorithm in such a manner that the rotational speed of the drafting rolls is adapted (quasi) continually relative to the rotational speed of the intake rolls in order to counteract the deviations detected of the fibre sliver weight from the desired value.

iv) The device 44 controls the motor M in function of the desired value Ds.

v) The draft ratio in the drafting zone VF (FIG. 3A) is changed as a function of the rotational speed of the drafting during rolls 426A, 428A.

The device 48 also could be arranged downstream from the pair of rolls 426A, 428A and be laid out as a sensor which "directly" is influenced by the fibre sliver. One possible solution would be e.g. a funnel which pneumatically generates a signal which depends on the fibre sliver weight, or a capacitive measuring sensor. In the preferred arrangement however, the device is laid out as a distance measuring sensor which measures the lift of the upper roll 428A (relative to the lower roll 426A) as a function of the quantity of the fibre substance present in the measuring room between these two rolls. This measuring principle is in use since a long time for measuring the fibre sliver weight at the delivery section of the card (see e.g. EP-C-186741) and also was proposed for measuring the fibre sliver weight at the intake of a drafting system (EP-A-643160). It thus is not explained in more detail here. The difference compared to the earlier applications is seen in that the measured values are made use of immediately for levelling out the deviations detected as the rolls 426A, 428Aserve as drafting rolls as well as measuring rolls. The same measuring values of course can be used for the long term card regulation (sliver weight control) for which purpose the measuring valves should be transmitted (possibly via the regulating device 42) to the computer 400.

The advantages of the new arrangement are:

1. Sliver weight checking procedure (required for calibrating the measuring system) can be effected in relatively simple manner.
2. The measured values concern the end product and can be displayed as end product data (fibre sliver weight, quality data, . . . )
3. The regulating parameters can be pre-set in much simpler manner than in the case of an "open loop" control system (e.g.) according to EP-A-643160.

The wave lengths that can be influenced are somewhat greater than the ones that can be influenced by an "open end" control system- which, however, in a card is not of critical importance, particularly if the card itself is equipped with a short term regulating device.

Figure 4:
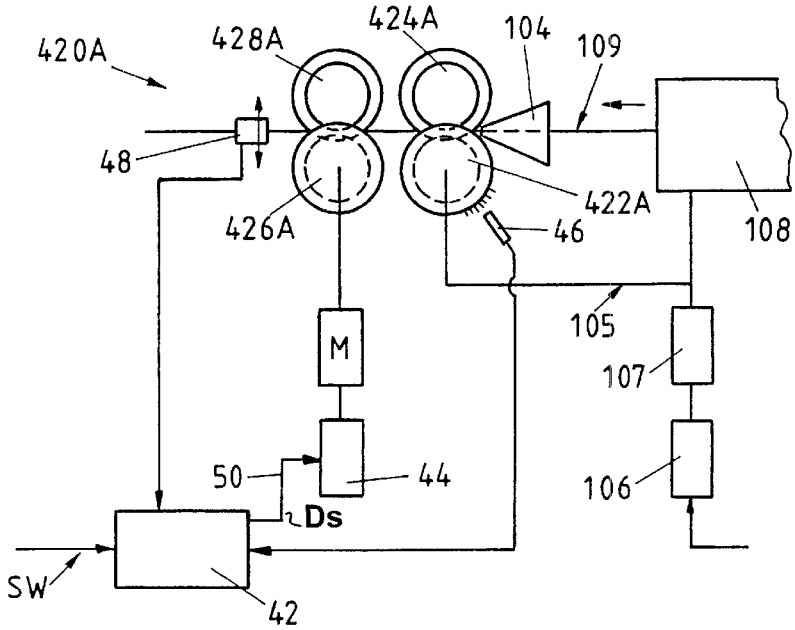
Figure 5:
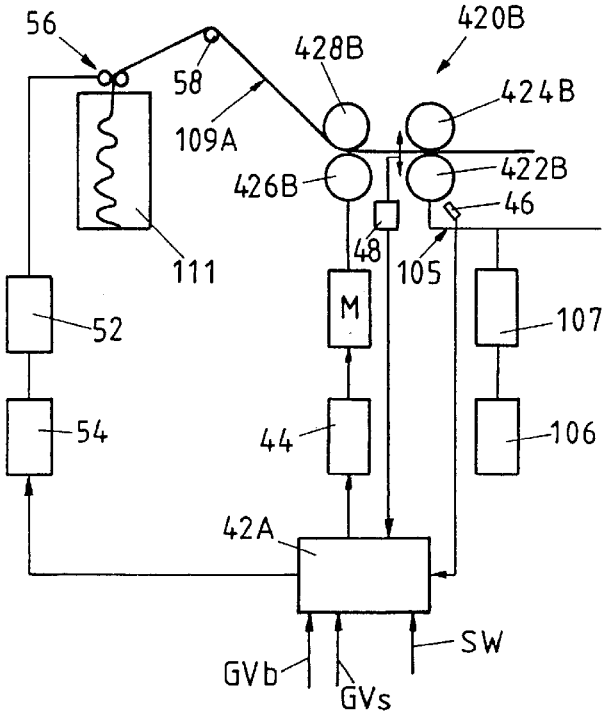

In the FIG. 5, a second variant of the drafting system module 420 is shown with an intake pair of rolls 422B, 424B and a delivery pair of rolls 426B, 428B. The reference numerals M, 44, 46 and 48 refer to elements designated with the same reference numerals in the FIG. 4. The regulating device in the FIG. 5 is designated 42A as in this variant it must fulfil an additional function which will be described in the following. It receives however, in any case, the output signal transmitted by the measuring device 46 as well as a desired value of the fibre sliver weight both entered via the input port SW. The measuring device 46 in this case is not receiving the signals concerning the sliver weight at the delivery pair of rolls but concerning the ones at the intake pair of rolls 422B, 424B in which case an "open loop" control of the draft in the drafting zone VF is feasible.

The regulating algorithm applied in the regulating device 42A accordingly must comprise a time delay function in order to take into account the path length covered by the not yet drafted fibre sliver between the measuring point in the nip point 430 (FIG. 3A) and the "virtual drafting point" in the drafting zone VF. This path length depends on the distance of the nip points 430, 432 as well as on the average staple length of the material to be processed.

In the FIG. 5 also a spinning can, or transporting can, 111 is shown which is being filled in the sliver depositing device 110 (FIG. 3), and a drive motor 52 with its own frequency inverter 54 driving the sliver depositing device. In the FIG. 5 only the drive connection of the motor 52 with the calender rolls 56 is indicated, but the motor is used also for driving other movable elements (not shown) of the sliver depositing device. The connection with the rolls 56 is of importance as the linear speed of the fibre sliver in the nip point of this pair of rolls determines the draft prevailing in the "free" sliver portion 109A between the drafting system module 420B and the sliver depositing device. The further draft up to the sliver deposition point within the sliver depositing device depends essentially on mechanical couplings between elements of the sliver depositing device and thus is held under control more easily.

The subdivision of the total draft between the card itself and the sliver depositing device now can be determined to a large extent by the regulating device 42A for which purpose it is provided with two further input ports for desired values namely one GVs for the base draft of the drafting system 420B and a second one GVb for the base draft between the drafting system and the calender rolls 56. The desired value GVs permits a base rotational speed of the lower drafting roll 426B to be determined (including determination of a corresponding base rotational speed of the output shaft of the motor M). The desired value GVb indicates the rotational speed at which the driven roll of the pair of rolls 56 actually must rotate if the machine is running but no sliver is delivered yet. It can be assumed that at that moment in time a "base difference" GD between the linear (tangential) speed in the nip point 432 (FIG. 3A) and the linear (tangential) speed in the nip point of the pair of rolls 56 prevails (Which "difference" can be "Zero" if the system is conceived in such a manner, a predetermined average draft, of e.g. 5%, being perfectly normal).

The current actual rotational speed of the roll 426B is not determined (only) by the base draft (desired value GVs), it rather is (quasi) continually adapted relative to the base rotational speed as a function of the deviations detected in the fibre sliver weight. The question then arises as to how the drive of the sliver depositing device will behave. In case the rotational speed of the calender roll 56 would be maintained constant, it would in principle be possible that the weight deviations levelled out in the drafting system 420B could be re-introduced into the fibre sliver 109A between the drafting system and the sliver depositing device. On the other hand, it is not possible to avoid erroneous draft by driving the sliver depositing device synchronously with the delivery rolls 426B, 428B of the drafting system as the inertia of the sliver depositing precludes this solution.

One tries to bypass these problems in that a guide roll 58 arranged on a "dancer arm" (not shown) is provided on the sliver portion 109A serving as a small "storage device" for temporarily "excessive" sliver lengths. The elasticity of the fibre sliver portion 109A itself also assists the reduction of erroneous drafts. In a continually changing draft between the pairs of rolls 426B, 428B and 56 it is impossible, however, to avoid smaller or greater erroneous drafts altogether. According to the second aspect of the present invention, they can be kept within narrow limits however, as will be explained in the following.

As mentioned already, the regulating algorithm in the regulating device 42A comprises a time delay component, i.e. the change of the rotational speed of the roil 426B to be effected is "known" to the regulating device in advance, before the change actually is effected. But the regulating device 42A also controls the rotational speed of the calender rolls 56 via the motor 52. It thus is feasible to "pre-control" the motor 52 relative to the motor M in such a manner that the current speed differential at the respective nip points relative to the above mentioned "base difference deviates minimally, or at least only within predetermined tolerances. The short wave disturbances which are levelled out in the drafting system 420 present an approximately stochastic pattern, varying about an average value. It thus is feasible to maintain a predetermined average draft, of e.g. 5% between the drafting system and the regulating device.

Figure 4A:
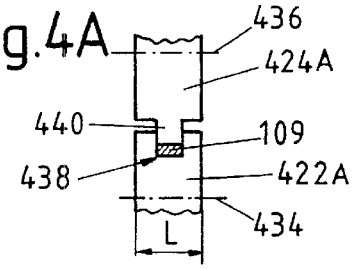

The same arrangement can be supplied in principle in an embodiment according to the FIG. 4 where it reduces the storage capacity requirements, or requirements to which concerning the elasticity of the fibre sliver. Owing to this, the stresses to which the fibre sliver portion 109A is subject can be kept within limits. The second aspect of the present invention presents greater advantages in an embodiment according to the FIG. 5.

Figure 6:
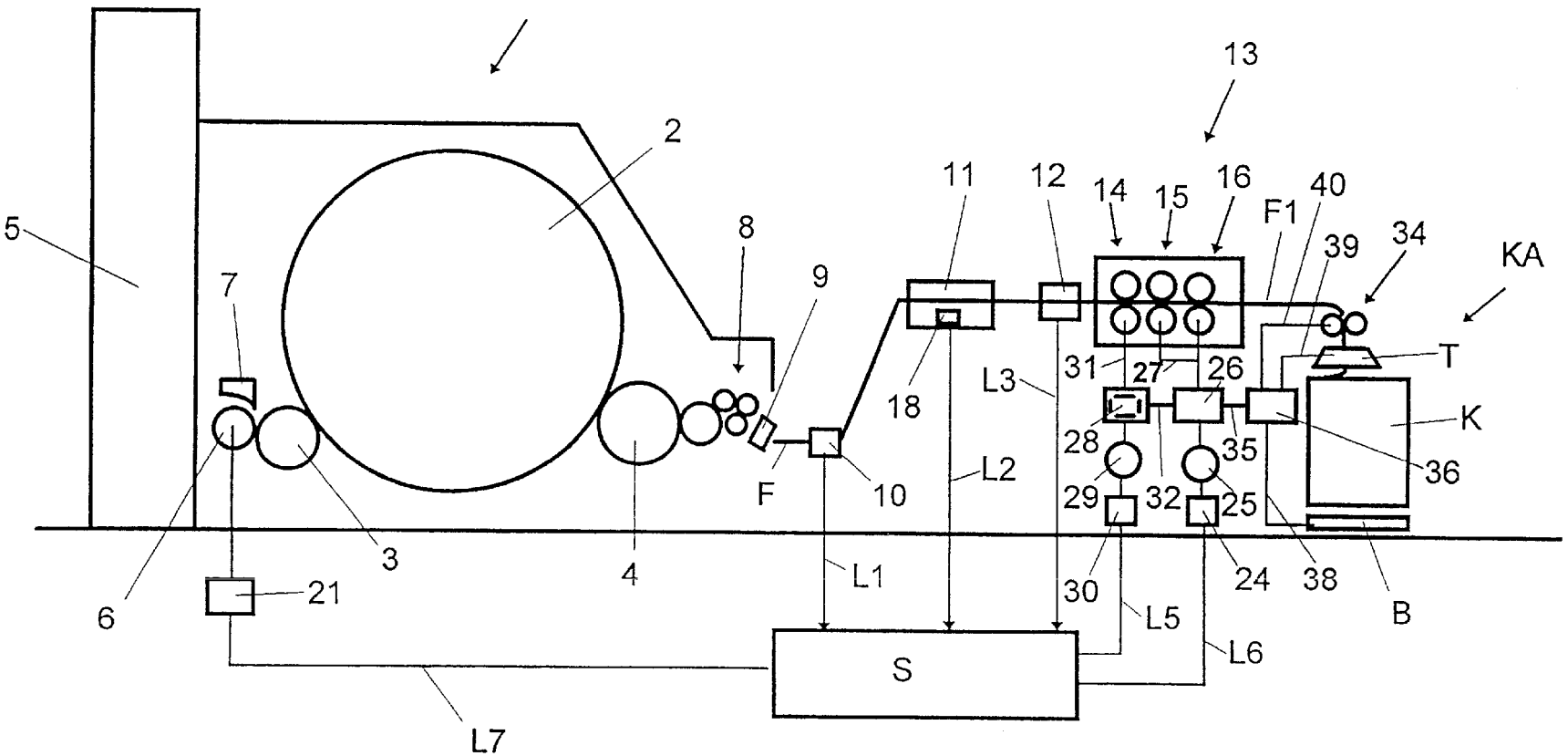

In the FIG. 6, a card, 1 is shown which is equipped with a main drum 2. The fibre material supplied via a schematically shown feed chute 5 is transferred via a feed roll 6 and a licker-in 3 to the main drum 2. Above the feed roll 6 a feed trough 7 is arranged. The feed trough 7 can, in a manner known as such, be arranged movably and at the same time it serves as a sensor scanning material unevenness with respect to the quantity of material supplied. Based on the measuring signal obtained the supply of the fibre material from the feed chute can be controlled.

Via a take-off roll 4, the fibres opened by the main drum 2 are taken off and the material is transferred to subsequently arranged web transport rolls 8. Illustration of a revolving flat with clothings cooperating with the main drum 2 has been dispensed with.

The fibre web transported and carried on by the transporting rolls 8 is transferred to a transverse transporting belt 9. Owing to the lateral transport, and the lateral take-off of the fibre web via the transverse transporting belt 9, a fibre sliver F is formed. For forming this fibre sliver F, which at the end of the lateral transporting belt 9 must be deflected, deflecting means (not shown), and funnel elements respectively, are used. The fibre sliver F, also called card sliver, subsequently is taken through a sensor 10 which determined the fibre mass (actual value) and via a circuit L1 transmits a corresponding signal to a control unit S. The sensor 10 in this arrangement serves essentially for scanning long term changes, and detecting drift in the fibre sliver mass deviating from a pre-set desired value. Based on the signals corresponding to the actual values given off by the sensor and on the comparison with a desired value stored in the control unit S, a control impulse is generated if needed which via the circuit L7 is transmitted to the drive arrangement 21 of the feed roll 6 for controlling action. Owing to this after-regulation of the drive 21, and the change in the rotational speed of the feed roll respectively, the mass deviations detected by the sensor 10 can be regulated after a time delay.

The fibre sliver F passing through the sensor 10 reaches a schematically shown fibre sliver storage device 11 which serves as a buffer sector for the fibre sliver for evening out differences in the transporting speed of the fibre sliver between the delivery arrangement of the card and a subsequent regulating drafting system 13. The fibre sliver storage device 11 is provided with a checking sensor 18 which via the circuit L2 transmits a signal to the control unit S. Before the fibre sliver F given off by the storage device 11 reaches the regulating drafting system 13, it is scanned by a sensor 12 which transmits the values determined via the circuit L3 to the control unit S.

The drafting system 13 according to the example shown consists of three pairs of rolls 143, 14 and 16 arranged behind each other in which arrangement the intake pair of rolls 14 is driven at variable rotational speed for levelling out mass deviations in the fibre sliver. The pair of delivery rolls 16 is driven at constant speed by a main motor 25 via a gear arrangement 26 subsequently. As indicated schematically with the drive train 27, also the intermediate pair of rolls 15 is driven at constant speed and presents a constant ratio of rotational speeds in relation to the subsequently arranged delivery rolls 16. Owing to the pre-determined ration of rotational speeds, the fibre sliver is subject to a constant draft between the pairs of rolls 15 and 16. The motor 25 is controlled by the control unit S via a frequency inverter and via the circuit L6. Via the drive connection 32, a differential gear arrangement 28 is driven which via the drive train 31 drives the intake pair of rolls 14. The drive of the differential gear arrangement 28 can be overridden by a regulating motor 29 which via the frequency inverter 30 and the circuit L5 is controlled by the control unit S. This overriding action is effected based on the signals given off by the sensor 12 which are compared with a desired value stored in the control unit S.

Downstream from the regulating drafting system 13, a sliver depositing device KA with cans is arranged in which the fibre sliver F1 delivered by the drafting system via a pair of calender rolls 34 and a funnel wheel T is deposited into a can K. The can K is placed on a driven can turntable B which rotates the can K during the filling process. The can turntable B is driven via the drive train 38 by a gear arrangement 36. Via the drive train 40 and 39 the calender rolls 34 and the funnel wheel T also are driven by this gear arrangement 36. The gear arrangement 36 in turn is driven via the schematically shown fixed drive connection 35 of the gear arrangement 26 which is driven by the main motor 25. From this it can be seen that the pair of delivery rolls 16 and the drive elements of the sliver depositing device KA are rigidly coupled directly via the gear arrangement 26. This means that if the gear arrangement 26 is driven at a lower rotational speed by the motor 25, the base rotational speed of the pairs of rolls 14, 15, and 16 is lowered on one hand and on the other hand simultaneously the rotational speed of the calender rolls 34 of the funnel wheel T and of the can turntable B of the sliver depositing arrangement KA are lowered.

The fibre sliver F generated by the card 1 and delivered via the transverse transporting belt is scanned by a sensor and its mass is measured. The values measured are transmitted to the control unit S where they are compared with a desired value. If the measured actual value deviates from the desired value on one hand a control signal is transmitted via the circuit L7 to the drive 20 of the feed roll 6 for after-regulating the rotational speed. At the same time this signal on the other hand also is used for the after-regulation of the base rotational speed of the motor 25 in order to already compensate for the effect of the regulating action in the regulating drafting system, which is to be expected, in such a manner that no more substantial influence is exerted on the filling height level of the preceding sliver storage device. As an additional level sensor of the sliver storage device can be used. In this arrangement the control device can be set in such a manner that the signal of the filling height level sensor is used additionally for influencing the base rotational speed only if its signal exceeds the pre-determined tolerance field. In this manner additional security is obtained concerning the functionality of the first sensor arranged at the card delivery. If the signal of the filling height level sensor persistently exceeds its pre-determined tolerance field, the functionality of the first sensor is to be checked. As the regulating action at the feed roll 6 is effected relatively late and after a time delay, the deviation of the mass from a desired value detected by the sensor 10 is to be levelled out entirely by the regulating drafting system 13 arranged subsequently.

Figure 7:
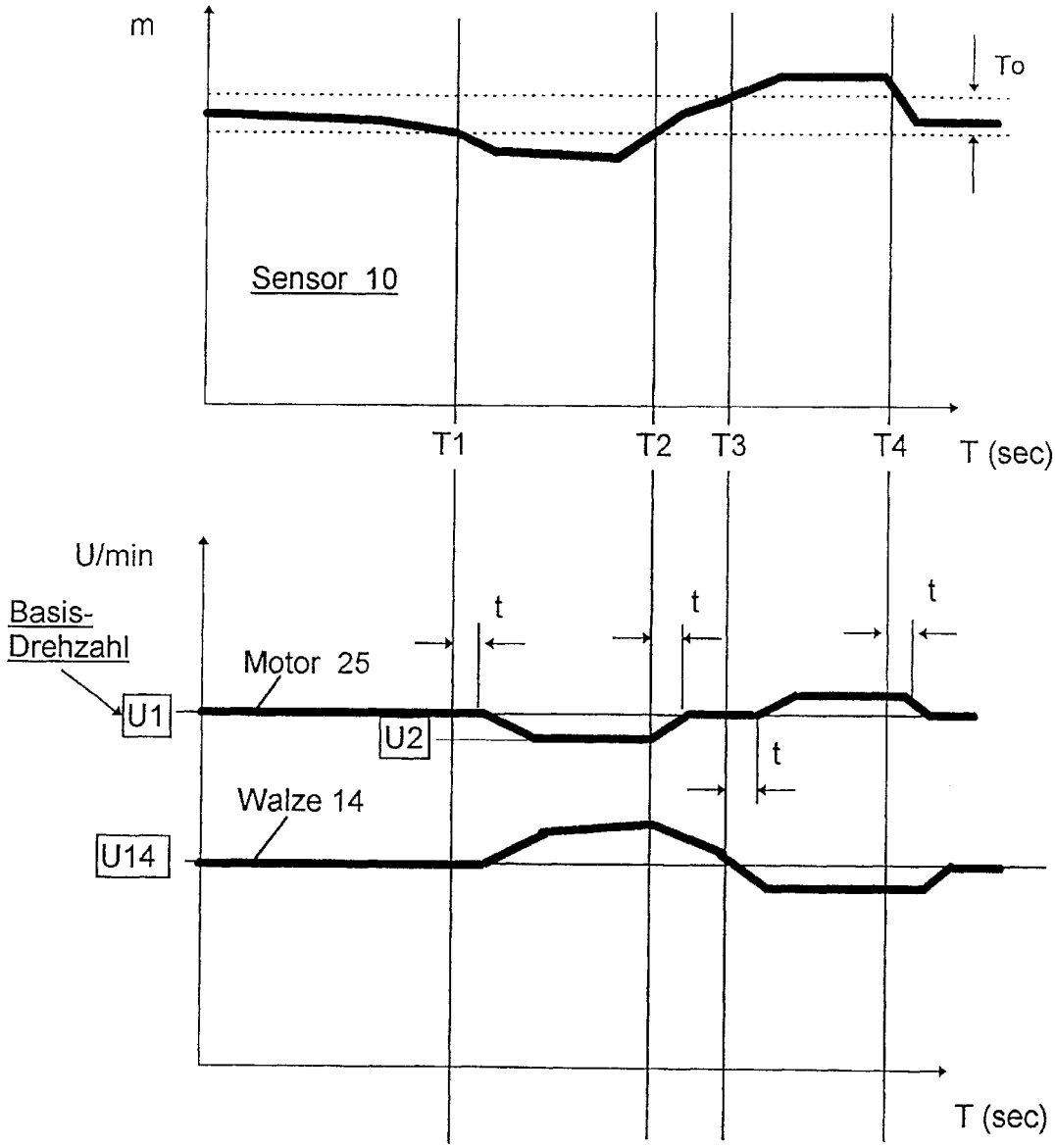

This levelling action now is explained in more detail to the diagrams shown in the FIG. 7. Starting out from a base rotational speed, or an operating rotational speed U1 at the time moment T1 via the sensor 10, or via the sensor 18 respectively, drifting of the mass m is detected which exceeds a pre-determined tolerance zone To. If the drifting of the mass at the time moment T1 would occur without any action being effected in the base rotational speed, the process would be the following: due to the lower mass presented to the drafting system 13 the draft between the pairs of rolls 14 and 15 must be lowered. This means that via the regulating motor 29 and the differential gear arrangement 28, the rotational speed of the intake pair of rolls 14 is increased in such a manner that the draft between the pairs of rolls 14 and 15 is reduced whereas the rotational speed of the pair of rolls 15 remains constant. Owing to the reduction in the rotational speed of the intake pair of rolls 14, also the intake speed of the card fibre sliver F is reduced. The card, and its take-off roll respectively, being driven at constant speed, the original delivery speed of the card fibre sliver is maintained. The difference thus generated between the delivery speed of the card and the changed intake speed of the fibre sliver into the drafting system 13 is taken care of by the fibre sliver storage device 11. This means that excessive quantities of fibre sliver F fills the fibre sliver storage age device 11 until again the same relations are established between the card delivery speed and the drafting system. This balance can be re-established as soon as the regulating action effected at the feed roll 6 has taken effect at the card delivery. If the mass deviations alternatingly occur up and down no greater influence is exerted onto the filling height level in the sliver storage device 11. The sliver storage device 11 merely must present sufficient storage capacity. If, however, such mass deviations occur at periodic or random intervals essentially in one and the same direction, the buffer capacity of the sliver storage device 11 soon reaches its limits.

In order to avoid these disadvantages and to keep the capacity of the fibre sliver storage device to a minimum, now a corrective action is effected, as claimed according to the present invention, in the base rotational speed of the drive motor 25. As, e.g. at the time moment T1, the mass deviation detected via the sensor 10 exceeds a pre-determined tolerance zone To after a time delay t also the rotational speed of the motor 25 is changed. From the upper part of the diagram shown it can be seen that the mass is reduced and that thus also the draft in the drafting system 13 must be reduced by increasing the rotational speed of the intake pair of rolls 14. If now, as shown in the FIG. 7 in the lower part of the diagram, the base rotational speed of the motor 25 is lowered to U2, the increase in the rotational speed caused via the regulating motor 29 with respect to the pair of rolls 15 is compensated for almost completely. This can be seen in particular from the two curves in the lower part of the FIG. 3 the lower curve showing the change in rotational speed of the intake pair of rolls 14 with respect to a rotational speed of the pair of rolls 15 which remains constant. From this it can be seen that the reduction in mass of the fibre sliver delivered detected by the sensor 10 at the time moment T1 leads to an increase in the rotational speed U14 of the roll 14 with respect to the pair of rolls 15 in order to level out this thin place by reducing the draft. If the signal of the sliver storage device 18 still is within a predetermined tolerance zone, no additional control signal is generated for further influencing the base rotational speed. If at the same time the base rotational speed U1 of the motor 25 is lowered, this change in the rotational speed of the roll 14 is compensated for approximately completely, i.e. the whole level of rotational speeds of the drafting system 1 is lowered uniformly owing to the drive interconnection in such a manner that in spite of a change in the ratio of the rotational speeds between the pairs of rolls 14 and 15, the rotational speed now prevailing in the intake pair of rolls is at about the same level as before the regulating action had taken place. This makes it possible that the intake speed of the fibre sliver F, also after a regulating action has taken place, and after the change in the ratio of the rotational speeds, remains at about the same level. Thus it becomes feasible that the sliver storage device 11 merely is used for levelling out short term regulating actions, the long term deviations being levelled out by changes in the base rotational speed of the motor 25. The sensor in this arrangement merely serves as an additional checking device. For better clarity in the curve concerning the roll 14 illustration of the peaks caused by short term regulating actions was dispensed with. These short wave regulating actions as a rule tend to oscillate up and down about the curve shown.

By lowering the base rotational speed, also the rotational speed of the drive elements of the sliver depositing device are lowered synchronously in such a manner that the ration of the rotational speed between the delivery roll 16 and the calender roll 34 is maintained constant. This levelling out of long term drift in the fibre mass can be effected relatively gently and slowly in such a manner that also the speed adaptation of the elements of the sliver depositing device KA presenting relatively high inertia does not cause problems.

Using the proposed arrangement on one hand with the help of the sensor devices already known, timely reaction to long term deviation in the fibre sliver mass becomes feasible, and on the other hand the storage capacity of the sliver storage device required for the regulation at the intake of the drafting system can be kept to a minimum.

The arrangement according to the FIG. 6 also could be modified according to the FIG. 4 and/or to the FIG. 5. Instead of a drafting system 13 (FIG. 6) with draft regulation at the intake also e.g. a drafting system 420A according to the FIG. 4 could be used, in which arrangement the base rotational speed of this drafting system also is influenced by a sensor 10 arranged at the card delivery. Furthermore in this case the drive of the sliver depositing device KA (FIG. 6) could be influenced according to the FIG. 5 as its coupling to the delivery arrangement of the drafting system no longer makes sense.

It should be appreciated by those skilled in the art that modifications and variations can be made to the embodiments of the invention described herein without departing from the scope and spirit of the invention as set forth in the appended claims.

What is claimed is:

1. A textile processing machine comprising a carding machine and a regulated fibre sliver drafting system incorporated into a delivery end of said carding machine, said drafting system further comprising fibre sliver sensor elements disposed to generate measuring values from the drafted fibre sliver, said measuring values subsequently acted upon by said drafting system for regulation of fibre sliver drafting in a closed loop regulation system, and wherein said drafting system comprises drafting bodies, at least certain ones of said drafting bodies also serving as said sliver sensor elements.

2. The machine as in claim 1, wherein said drafting bodies also form a delivery end arrangement of said carding machine such that an intake arrangement of said drafting bodies are driven at a rotational speed corresponding to a fibre sliver delivery speed of said carding machine.

3. The machine as in claim 2, wherein said delivery end arrangement further comprises a drive, said intake arrangement of said drafting bodies operationally coupled with said drive so as to be synchronously driven with said delivery end.

4. The machine as in claim 2, wherein said intake arrangement of said drafting bodies further comprises at least one measuring element disposed to sense and measure a fibre sliver characteristic acted upon by said drafting system.

5. The machine as in claim 1, wherein said carding machine further comprising a card regulating device, said card regulating device configured to receive and act upon said drafting system measuring values for regulating sliver weight on said carding machine.

6. A textile processing machine comprising a carding machine and a regulated fibre sliver drafting system incorporated into a delivery end of said carding machine, said drafting system further comprising fibre sliver sensor elements disposed to generate measuring values from the drafted fibre sliver, said measuring values subsequently acted upon by said drafting system for regulation of fibre sliver drafting in a closed loop regulation system; said carding machine further comprising a card regulating device, said card regulating device configured to receive and act upon said drafting system measuring values for regulating sliver weight on said carding machine; and wherein said card regulating device is configured to level out short wave variations in a fibre lap layer taken in by said carding machine.

7. A carding machine, comprising:

a main card having a delivery arrangement for delivering fibre sliver at a delivery speed;

a regulated drafting system incorporated into said delivery arrangement, said drafting system comprising intake drafting bodies and delivery drafting bodies, said drafting system controlling draft of the fibre sliver by varying delivery speed of the fibre sliver;

fibre sliver sensor elements configured with said drafting system for generating measuring values of the drafted sliver acted upon by said drafting system in a closed loop system; and a sliver depositing device disposed downstream from said drafting system and including a drive controlled as a function of said drafting system measuring values such that a fibre sliver portion extending between said drafting system and said depositing device is maintained within a predetermined length with changes of said fibre delivery speed from said delivery arrangement.

8. A carding machine, comprising:

a main card having a delivery arrangement for delivering fibre sliver at a delivery speed;

a regulated drafting system configured with said delivery arrangement, said drafting system comprising intake drafting bodies and delivery drafting bodies, said drafting system controlling draft of the fibre sliver by varying delivery speed of the fibre sliver;

fibre sliver sensor elements configured with said drafting system for generating measuring values of the drafted sliver acted upon by said drafting system in a closed loop system;

a sliver depositing device disposed downstream from said drafting system and including a drive controlled as a function of said drafting system measuring values such that a fibre sliver portion extending between said drafting system and said depositing device is maintained within a predetermined length with changes of said fibre delivery speed from said delivery arrangement; and wherein an adjustment to said drafting bodies determined by said drafting system is applied to said drive of said sliver depositing device at a predetermined time lag so as to minimize deviations in fibre sliver length between said drafting system and said depositing device as a function of changes in delivery speed.

9. A carding machine, comprising:

a main card having a supply device for supplying fibre material to said card and a delivery arrangement for delivering a fibre sliver from said card at a delivery speed;

a regulated drafting system configured with said delivery arrangement, said drafting system comprising drafting bodies and a sensor disposed to measure mass of the drafted fibre sliver delivered by said card, said drafting system acting upon the measured mass to regulate draft of the fibre sliver at said delivery arrangement as a function of already drafted fibre sliver;

said sensor in communication with said supply device such that supply of fibre material to said card is regulated as a function of drafting by said drafting system;

a fibre sliver storage device disposed upstream of said drafting system; and a drive for said drafting system configured to provide a base rotational speed to said drafting bodies, said sensor disposed between said main card and said drafting system such that said base rotational speed is regulated by said drafting system as a function of a control signal generated by said sensor.

10. The machine as in claim 9, wherein said sliver storage device further comprises a filling height level sensor configured to generate a control signal acted upon by said drafting system for regulating said base rotational speed.

11. The machine as in claim 9, wherein said drafting system comprises intake drafting bodies and delivery drafting bodies, a rotational speed of said intake drafting rolls regulated as a function of said base rotational speed by said drafting system for leveling out mass deviations in the fibre sliver.

12. The machine as in claim 9, further comprising a sliver depositing device disposed downstream from said delivery arrangement, said depositing device further comprising a drive connected to said drafting system drive and thereby driven as a function of said base rotational speed.

13. The machine as in claim 9, wherein said sensor is disposed upstream of said fibre sliver storage device, and further comprising at least one additional fibre sliver sensor disposed downstream from said fibre sliver storage device, said additional sensor generating a control signal for said drafting system.

14. The machine as in claim 13, wherein said drafting system comprises intake drafting bodies and delivery drafting bodies driven by a common drive, and wherein said drafting system uses said control signal from said additional sensor to separately regulate the rotational speed of said intake drafting bodies.

15. The machine as in claim 14, further comprising an additional drive for said intake drafting bodies, said drafting system separately regulating the rotational speed of said intake drafting bodies with said additional drive as a function of said control signal from said additional senor upon a predetermined deviation between said control signal and a desired value of said control signal.

* * * * *